US008919415B1

(12) United States Patent
Crider

(10) Patent No.: US 8,919,415 B1
(45) Date of Patent: Dec. 30, 2014

(54) CURTAIN CLOSURE SYSTEM HAVING IMPACT RESISTANT TENSION BAR

(71) Applicant: Grant W. Crider, Bremen, AL (US)

(72) Inventor: Grant W. Crider, Bremen, AL (US)

( * ) Notice: Subject to any disclaimer, the term of this patent is extended or adjusted under 35 U.S.C. 154(b) by 0 days.

(21) Appl. No.: 13/910,628

(22) Filed: Jun. 5, 2013

(51) Int. Cl.
*A47H 1/00* (2006.01)
*E06B 9/42* (2006.01)

(52) U.S. Cl.
CPC ..... *E06B 9/42* (2013.01)
USPC ..... 160/85; 160/241

(58) Field of Classification Search
USPC ..... 160/85, 86, 241, 349.1, DIG. 11
See application file for complete search history.

(56) References Cited

U.S. PATENT DOCUMENTS 5,207,256 A * 5/1993 Kraeutler ..... 160/84.02
5,222,541 A * 6/1993 Hornberger ..... 160/265
5,351,742 A * 10/1994 Lichy ..... 160/273.1
5,566,736 A 10/1996 Crider et al.
5,667,648 A * 9/1997 McDonald ..... 204/245
5,752,557 A 5/1998 Crider et al.
5,785,105 A 7/1998 Crider et al.
5,960,847 A 10/1999 Crider et al.
6,089,305 A * 7/2000 Gruben et al. ..... 160/271
6,138,739 A 10/2000 Crider et al.
6,942,001 B1 9/2005 Crider et al.
7,128,125 B2 10/2006 Harbison
7,231,953 B2 * 6/2007 Varley et al. ..... 160/273.1
7,631,683 B2 12/2009 Crider
7,802,607 B2 9/2010 Crider
7,828,037 B2 11/2010 Crider
8,016,014 B2 9/2011 Crider et al.
8,069,897 B2 * 12/2011 Kraeutler ..... 160/3
8,439,099 B1 5/2013 Crider
2007/0193698 A1 * 8/2007 Kraeutler ..... 160/36
2007/0261305 A1 * 11/2007 Kraeutler ..... 49/27

* cited by examiner

*Primary Examiner* — Katherine Mitchell
*Assistant Examiner* — Abe Massad
(74) *Attorney, Agent, or Firm* — Bush Intellectual Property Law; Kenneth M. Bush

(57) ABSTRACT

A roll-up curtain closure system having an impact resistant tension rod, wherein the system includes at least one flexible curtain having a first end fixedly attached adjacent a portal along a first end thereof and a second end folded back on itself to define a pocket opening towards the portal first end, an elongated tension rod captured within the pocket, and a curtain driving mechanism operably connected to the curtain second end for varying the height of the pocket. The elongated tension rod comprises an inner flexible fiberglass bar surrounded by an outer soft closed cell foam material, whereby the tension rod is flexible to bend in response to impact force and is resilient to return to its original position after the impact force is removed.

7 Claims, 3 Drawing Sheets

CURTAIN CLOSURE SYSTEM HAVING IMPACT RESISTANT TENSION BAR

FIELD OF THE INVENTION

The present invention relates to closures for windows, doors, or other portals and, more particularly, to roll-up curtain closure systems.

BACKGROUND OF THE INVENTION

Roll-up closure systems utilizing a flexible cover or curtain to cover a portal or opening such as a door or window are known. For example, in U.S. Pat. No. 5,566,736, Crider et al. teach a sealable curtain wherein each lateral margin of the curtain has a strip of hook and loop fastener material affixed thereto, and a complementary strip is affixed to the lateral margins of the structure defining the portal. A first end of the curtain is rigidly affixed across an upper margin of the portal. The opposite end of the curtain can be upturned and connected to a driven take-up roller mounted next to the upper margin of the portal. In this embodiment, an elongated transverse rod is supported within the upturned end of the curtain to maintain tension on the curtain. In a second embodiment, a second elongated transverse rod can be utilized to assist in maintaining tension on the curtain (see FIGS. 1-2 of the U.S. Pat. No. 5,566,736). In a third embodiment, a second curtain can be employed (see FIG. 5 of the U.S. Pat. No. 5,566,736). In any of the embodiments, activation of the driven take-up roller lengthens or shortens the effective length of the curtain (s) while positioning the mating hook and loop fasteners to seal and unseal the curtain(s) to the lateral margins of the portal.

Galvanized steel pipes have historically been used as the transverse tension rods in the roll-up curtain systems described above. Occasionally, machinery (e.g. a forklift) will impact and bend the steel pipe(s). When this occurs, the curtain will not roll-up properly and, as a result, the curtain system and the portal associated therewith must be placed out of service until the steel pipe(s) can be repaired or replaced. Accordingly, what is needed is a tension rod for use in a roll-up curtain closure system that provides adequate curtain tension and structural support, yet is flexible and resilient to avoid damage as a result of impact by machinery and the like.

SUMMARY OF THE INVENTION

The present invention is a roll-up curtain closure system having impact resistant tension rod(s), wherein a first preferred embodiment comprises a pair of spaced apart opposing lateral margins defining opposing sides of the portal, a flexible curtain having a first end and a second end each having a dimension commensurate with the separation of the portal lateral margins wherein the curtain first end is fixedly attached adjacent the portal along a first end thereof and the curtain second end is folded back on itself to define a pocket opening towards the portal first end, an elongated tension rod captured within the pocket, and a curtain driving mechanism operably connected to the curtain second end for varying the height of the pocket. The elongated tension rod comprises an inner flexible bar surrounded by an outer soft foam material, whereby the elongated rod is flexible to bend in response to impact force and is resilient to return to its original linear orientation after the impact force is removed. The flexible bar is preferably an extruded fiberglass bar and the foam material is preferably a tubular closed cell foam.

A second preferred embodiment comprises a pair of spaced apart opposing lateral margins defining opposing sides of the portal, a first flexible curtain having a first end and a second end each having a dimension commensurate with the separation of the portal lateral margins wherein the curtain first end is fixedly attached adjacent the portal along a first end thereof and the curtain second end is folded back on itself to define a pocket opening towards the portal first end, a first elongated tension rod captured within the first curtain pocket, a second flexible curtain having a first end and a second end each having a dimension commensurate with the separation of the lateral margins wherein the curtain first end is fixedly attached adjacent the portal along a first end thereof and the curtain second end is folded back on itself to define a pocket opening towards the portal first end, a second elongated tension rod captured within the second curtain pocket, and a curtain driving mechanism operably connected to the second ends of the first and second curtains for varying the height of the pockets. Each of the first and second elongated tension rods comprises an inner flexible bar surrounded by an outer soft foam material, whereby the first and second elongated rods are flexible to bend in response to impact force and are resilient to return to their original linear orientation after the impact force is removed. Each flexible bar is preferably an extruded fiberglass bar and each foam material is preferably a tubular closed cell foam.

These and other features of the invention will become apparent from the following detailed description of the invention.

DETAILED DESCRIPTION OF THE INVENTION

Figure 1:
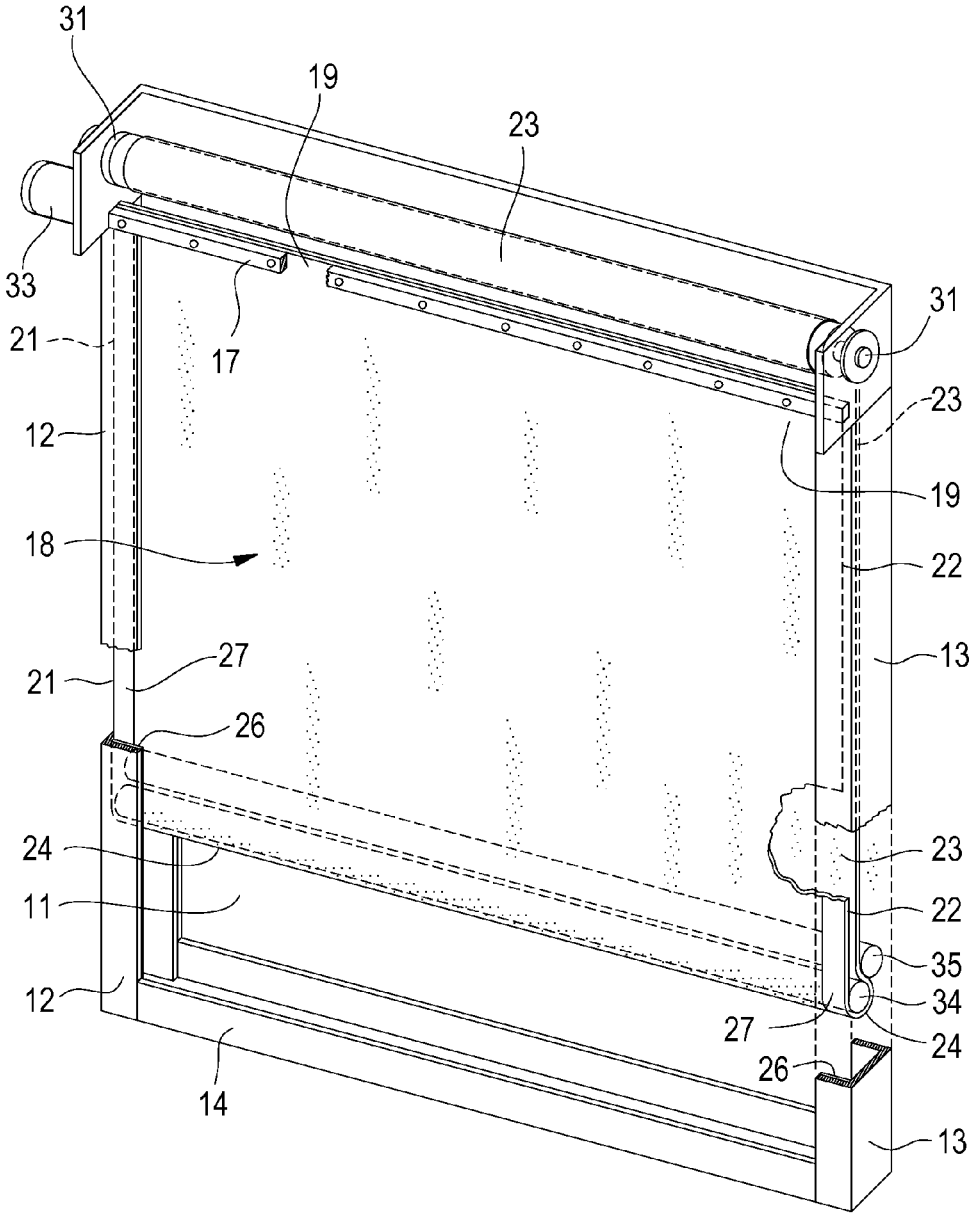
FIG. 1 is a perspective view of a first embodiment of the present invention in a partially raised position and shown partially in section.

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

The invention disclosed herein is technology related to U.S. Pat. Nos. 5,566,736, 5,752,557, 5,785,105, 5,960,847, and 6,138,739, the disclosures of which are incorporated herein by reference. A more complete understanding of the invention may be obtained by reference to FIGS. 1-3, wherein an opening 11 is preferably provided with a pair of inwardly facing channel members 12 and 13, being C-shaped in the horizontal plane. Channel members 12 and 13 extend the full vertical length of the opening 11 and may terminate at a lower channel 14, which is upwardly opening and which extends across the width of the opening. In the case of a door-type opening, lower channel 14 would not be present. In some applications a sealing gasket 16, such as a compressible layer of foam, will be useful in the bottom of lower channel 14. Across the top of opening 11 is preferably a brace 17 which extends from channel 12 to channel 13. Thus, it may be seen that the opening is completely framed by members 12, 13, 14, and 17.

Attached to brace 17 is a first end 19 of a curtain 18, which is a flexible material selected in accordance with the purposes of the present invention for its ability to block light, air, or moisture from one side to the other side thereof. Therefore, curtain 18 is properly defined as a flexible barrier material, having a first end 19 secured to brace 17 and opposing longitudinal sides 21 and 22 which are longer than the length of channel members 12 and 13 such that the curtain 18 has an upturned lower end 23. Attached to channels 12 and 13 and to sides 21 and 22 are interacting closure members 26 and 27 (e.g. hook and loop fastener) capable of being selectively attached to and detached from each other.

The upturned end 23 may be directly connected to a transverse take-up spindle 31 mounted for rotation above the tops of channels 12 and 13. Alternatively, end 23 may be connected to the spindle 31 by cables or straps, and the spindle may include a spool for such cables or straps. In any case, the spindle 31 is driven by a reversible motor 33 attached to a selected means of control and spindle 31 supports the upturned end 23. An elongated transverse rod 34 is supported within the pocket 24 of the curtain 18 created by the upturned end 23 and has opposing ends which preferably extend into the opposing channels 12 and 13 such that rod 34 can roll freely vertically in the channels, but cannot significantly pivot in the horizontal plane about its midpoint. Thus, as spindle 31 is rotated to wrap lower end 23 thereon, rod 34 is lifted within channel 12 and 13 such that it rolls up the channels 12 and 13.

As shown in FIG. 1, a second elongated transverse rod 35 is preferably captured at opposing ends within the channels 12 and 13 parallel to first rod 34. Second rod 35 is separated from first rod 34 by the upturned end 23 of curtain 18. Thus, as spindle 31 rotates rods 34 and 35 are constrained to rotate in opposite direction with the upturned end 23 of flexible curtain 18 passing between the rollers. As spindle 31 unwraps the curtain 18 or straps from itself, gravity urges the rods 34, 35 and curtain to a lowered position.

When the curtain 18 is lowered, the first rod 34 provides a very important function. Because the rod 34 is always in the bottom of the pocket 24, the rod 34 provides uniform weight across the width of the curtain 18 so that the curtain 18 is always taut and unwrinkled. As a result, the closure member 27 on the curtain 18 will properly align with the closure member 26 on the lateral margins 12, 13, thus maximizing the integrity of the seal between the closure members 26, 27.

Figure 2:
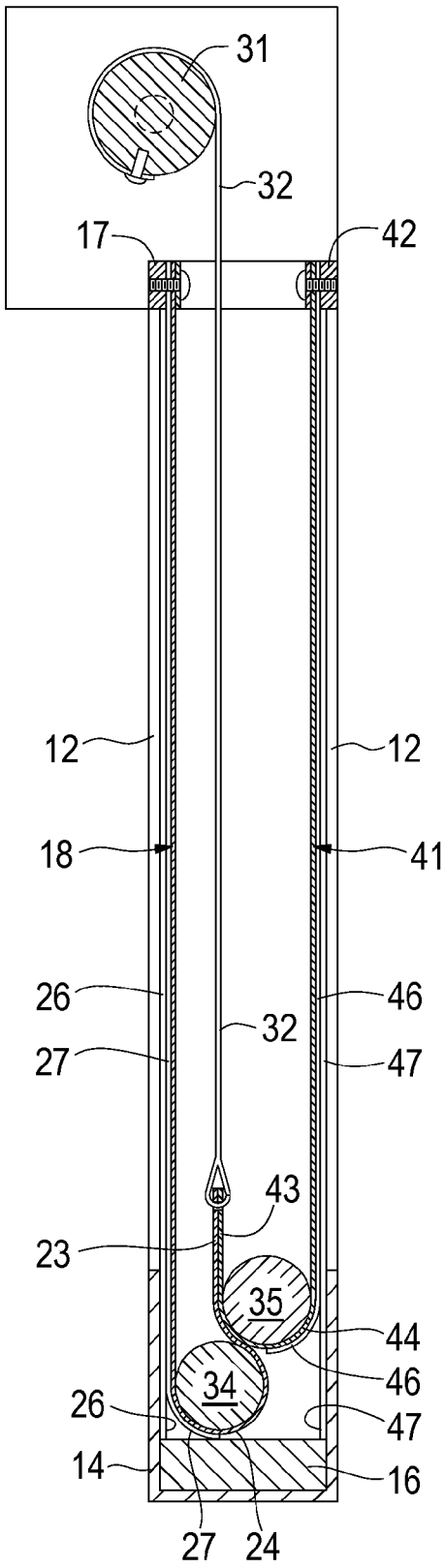
FIG. 2 is a side sectional view of a second embodiment of the present invention.

In an alternative embodiment shown in FIG. 2, a second curtain 41 is provided and is attached to a second brace 42. Second curtain 41 has the same structure as curtain 18 and has an upturned end 43 which passes beneath rod 35, but not rod 34. Thus, rod 35 is supported within the pocket 44 formed by upturned end 43 and serves the same function as rod 34, described above. Upturned ends 43 and 23 are attached such that they are commonly supported by spindle 31 via straps or common curtain 32, and move concomitantly vertically between braces 14 and 42. The dual curtain design has the added benefit of providing an insulating effect. It will be appreciated that the closure members 46 carried by curtain 41 mate with closure members 47 mounted on the channels 12 and 13 to provide a double sealed barrier. In some applications a sealing gasket 16, such as a compressible layer of foam-like material, will be useful in the bottom of lower channel 14.

Figure 3:
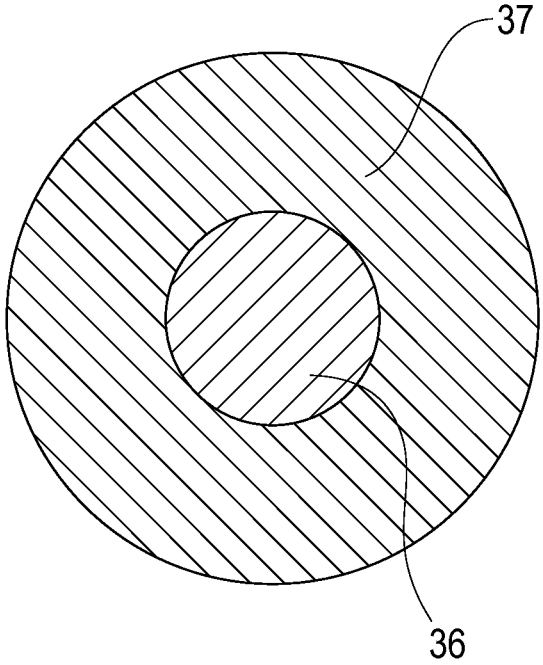
FIG. 3 is a cross-sectional view of a tension bar of the present invention.

As shown in FIG. 3, each elongated rod 34, 35 comprises an inner flexible bar 36 surrounded by an outer soft foam material 37. The flexible bar 36 is preferably a flexible and resilient extruded fiberglass bar having a diameter of about 1 inch, although other flexible and resilient materials and other dimensions could be used. The foam material 37 is preferably a flexible and resilient tubular closed cell foam having an unassembled inner diameter of about 0.875 inch and an outer diameter of about 2.375 inches, although other flexible and resilient materials and other dimensions could be used. The flexible bar 36 can be inserted into the hole within foam material 37, which stretches to receive the bar 36 therein and securely attaches to the bar 36. Once assembled, the outer diameter of the foam material 37 is stretched to about 2.5 inches. Thus, each elongated rod 34, 35 is flexible to bend in response to an impact force and is resilient to return to its original position after the impact force is removed. If the impact force is substantial, the elongated rods 34, 35 may bend until they come out of the channels 12, 13 (i.e. "breakaway"), but can be easily reinserted therein. Use of these flexible and resilient tension rods prevents damage to the closure system and thus avoids the closure system from being temporarily removed from service while awaiting repair. Further, the flexible and resilient features of the rods 34, 35, as well as the softness of the foam material 37, help to avoid injury to workers when inadvertently coming into contact with the rods 34, 35 while the closure system is in operation.

It will be understood that various changes in the details, materials, and arrangements of the parts which have been described and illustrated above in order to explain the nature of this invention may be made by those skilled in the art without departing from the principle and scope of the invention as described herein and as recited in the attached claims.

The invention claimed is:

1. An apparatus for opening and closing a portal in a structure, comprising:

a) a pair of spaced apart opposing lateral margins defining opposing sides of the portal;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) an elongated rod captured within said pocket;

d) a curtain driving mechanism operably connected to said second end of said curtain for varying the height of said pocket; and e) a first closure member attached to said lateral margins and a second closure member attached to said side portions of said curtain, wherein said first closure member is operable to reversibly attach to said second closure member and thereby reversibly seal said curtain to said lateral margins of the portal;

f) wherein said elongated rod comprises an inner flexible bar surrounded by an outer soft foam material that is securely attached to said flexible bar, wherein said flexible bar is an extruded fiberglass bar and said foam material is a closed cell foam, whereby said elongated rod is operable to provide uniform weight across the width of said curtain to keep said curtain taut and unwrinkled and thereby promote proper alignment of said first closure member with said second closure member, whereby said elongated rod is flexible to bend in response to impact force and is resilient to return to its original position after the impact force is removed, whereby said elongated rod is lifted within said pocket during operation of said curtain driving mechanism.

2. An apparatus according to claim 1, wherein said flexible bar has a diameter of 1 inch.

3. An apparatus according to claim 1, wherein said foam material has an outer diameter of 2.5 inches.

4. An apparatus for opening and closing a portal in a structure, comprising:

a) a pair of spaced apart opposing lateral margins defining opposing sides of the portal;

b) a first flexible curtain having elongated side portions, a first end and a second end each having a dimension commensurate with the separation of said lateral margins, with said first end of said first curtain being fixedly attached adjacent the portal along a first end thereof, said second end of said first curtain folded back on itself to define a pocket opening towards the first end of the portal;

c) a first elongated rod captured within said pocket of said first curtain;

d) a second flexible curtain having elongated side portions, a first end and a second end each having a dimension commensurate with the separation of said lateral margins, with said first end of said second curtain being fixedly attached adjacent the portal along the first end thereof, said second end of said second curtain folded back on itself to define a pocket opening towards the first end of the portal;

e) a second elongated rod captured within said pocket of said second curtain;

f) a curtain driving mechanism operably connected to said second ends of said first and second curtains for varying the height of said pockets;

g) a first closure member attached to said lateral margins and a second closure member attached to said side portions of said first curtain, wherein said first closure member is operable to reversibly attach to said second closure member and thereby reversibly seal said first curtain to said lateral margins of the portal; and h) a third closure member attached to said lateral margins and a fourth closure member attached to said side portions of said second curtain, wherein said third closure member is operable to reversibly attach to said fourth closure member and thereby reversibly seal said second curtain to said lateral margins of the portal;

i) wherein said first elongated rod comprises an inner flexible bar surrounded by an outer soft foam material that is securely attached to said flexible bar, wherein said flexible bar is an extruded fiberglass bar and said foam material is a closed cell foam, whereby said first elongated rod is operable to provide uniform weight across the width of said first curtain to keep said first curtain taut and unwrinkled and thereby promote proper alignment of said first closure member with said second closure member, whereby said first elongated rod is flexible to bend in response to impact force and is resilient to return to its original position after the impact force is removed;

j) wherein said second elongated rod comprises an inner flexible bar surrounded by an outer soft foam material that is securely attached to said flexible bar of said second elongated rod, wherein said flexible bar of said second elongated rod is an extruded fiberglass bar and said foam material of said second elongated rod is a closed cell foam, whereby said second elongated rod is operable to provide uniform weight across the width of said second curtain to keep said second curtain taut and unwrinkled and thereby promote proper alignment of said third closure member with said fourth closure member, whereby said second elongated rod is flexible to bend in response to impact force and is resilient to return to its original position after the impact force is removed, whereby said first elongated rod is lifted with said pocket of said first curtain and said second elongated rod is lifted within said pocket of said second curtain during operation of said curtain driving mechanism.

5. An apparatus according to claim 4, wherein said first elongated rod flexible bar has a diameter of 1 inch and said first elongated rod foam material has an outer diameter of 2.5 inches.

6. An apparatus according to claim 5, wherein said second elongated rod flexible bar has a diameter of 1 inch and said second elongated rod foam material has an outer diameter of 2.5 inches.

7. An apparatus for opening and closing a portal in a structure, comprising:

a) a pair of spaced apart opposing lateral margins defining opposing sides of the portal;

b) a first flexible curtain having elongated side portions, a first end and a second end each having a dimension commensurate with the separation of said lateral margins, with said first end of said first curtain being fixedly attached adjacent the portal along a first end thereof, said second end of said first curtain folded back on itself to define a pocket opening towards the first end of the portal;

c) a first elongated rod captured within said pocket of said first curtain;

d) a second flexible curtain having elongated side portions, a first end and a second end each having a dimension commensurate with the separation of said lateral margins, with said first end of said second curtain being fixedly attached adjacent the portal along the first end thereof, said second end of said second curtain folded back on itself to define a pocket opening towards the first end of the portal;

e) a second elongated rod captured within said pocket of said second curtain;

f) a curtain driving mechanism operably connected to said second ends of said first and second curtains for varying the height of said pockets;

g) a first closure member attached to said lateral margins and a second closure member attached to said side portions of said first curtain, wherein said first closure member is operable to reversibly attach to said second closure member and thereby reversibly seal said first curtain to said lateral margins of the portal; and h) a third closure member attached to said lateral margins and a fourth closure member attached to said side portions of said second curtain, wherein said third closure member is operable to reversibly attach to said fourth closure member and thereby reversibly seal said second curtain to said lateral margins of the portal;

i) wherein said first elongated rod comprises an inner flexible bar surrounded by an outer soft foam material that is securely attached to said flexible bar, wherein said flexible bar consists of an extruded fiberglass bar having a diameter of 1 inch and said foam material consists of a closed cell foam having an outer diameter of 2.5 inches, whereby said first elongated rod is operable to provide uniform weight across the width of said first curtain to keep said first curtain taut and unwrinkled and thereby promote proper alignment of said first closure member with said second closure member, whereby said first elongated rod is flexible to bend in response to impact force and is resilient to return to its original position after the impact force is removed;

j) wherein said second elongated rod comprises an inner flexible bar surrounded by an outer soft foam material that is securely attached to said flexible bar of said second elongated rod, wherein said flexible bar of said second elongated rod consists of an extruded fiberglass bar having a diameter of 1 inch and said foam material of said second elongated rod consists of a closed cell foam having an outer diameter of 2.5 inches, whereby said second elongated rod is operable to provide uniform weight across the width of said second curtain to keep said second curtain taut and unwrinkled and thereby promote proper alignment of said third closure member with said fourth closure member, whereby said second elongated rod is flexible to bend in response to impact force and is resilient to return to its original position after the impact force is removed, whereby said first elongated rod is lifted with said pocket of said first curtain and said second elongated rod is lifted within said pocket of said second curtain during operation of said curtain driving mechanism.

* * * * *